United States Patent [19]

Tissier

[11] 4,000,538

[45] Jan. 4, 1977

[54] CLEANING DEVICE

[76] Inventor: Jacques Tissier, 26 bis, rue de la Gaite, 94 Villejuif, France

[22] Filed: Mar. 10, 1975

[21] Appl. No.: 556,960

[30] Foreign Application Priority Data

Mar. 8, 1974 France ..... 74.07898

[52] U.S. Cl. ..... 15/320; 15/354; 15/385

[51] Int. Cl.[2] ..... A47L 11/30; A47L 11/293

[58] Field of Search ..... 15/320, 321, 385, 354

[56] References Cited

UNITED STATES PATENTS

| | | | |
|---|---|---|---|
| 2,250,177 | 7/1941 | Boccasile | 15/385 X |
| 2,731,659 | 1/1956 | Coplen | 15/320 |
| 3,375,540 | 4/1968 | Hyde | 15/320 |
| 3,624,668 | 11/1971 | Krause | 15/385 X |
| 3,686,707 | 8/1972 | Hughes et al. | 15/385 |

FOREIGN PATENTS OR APPLICATIONS

| | | | |
|---|---|---|---|
| 826,255 | 12/1959 | United Kingdom | 15/320 |

*Primary Examiner*—Christopher K. Moore
*Attorney, Agent, or Firm*—Weiser, Stapler & Spivak

[57] ABSTRACT

A cleaning device for scrubbing a floor surface including a rotatable cleaning disc. A circular ring surrounds the disc and terminates downwardly in spaced, flexible skirts which contact the floor surface. A flexible arm mounts the ring to permit vertical adjustment of the ring relative to the cleaning disc to compensate for brush wear and other irregularities. One or more flexible conduits intercommunicate between the interior of the ring and a hollow hub, and suction forces are applied through the conduit to the ring to remove dirty water from the floor and into machine mounted reservoir.

13 Claims, 2 Drawing Figures

CLEANING DEVICE

BACKGROUND OF THE INVENTION

The invention is concerned with an apparatus for cleaning surfaces, particularly floors by wet cleaning.

Machinery for wet cleaning of floors is known. Such devices generally have a motor which actuates a horizontal disc which has a vertical axis of rotation. The disc is provided with brushes or other abrasive means. A stationary or rotatable ring circumferentially encloses the disc and constitutes a closed area which is connected on one hand to a reservoir or container for the cleaning liquid and on the other hand to a reservoir for recovery of the used liquids.

The ring is provided with one or a multiplicity of flexible or elastic seals which are in contact with the surface to be cleaned. The seals enclose the cleaning disc to delineate the surface to be cleaned and to prevent the splashing of the cleaning liquid outside the area being cleaned.

The closed area so formed as described is subjected to a vacuum caused by a turbine which draws its suction from the cleaning liquid reservoir or container to insure the return of the cleaning liquids to this container.

In the devices so known from the prior art, it has been found advantageous in order to obtain a better hermeticity or waterproofness to rotate the circular ring which circumferentially surrounds the cleaning disc.

To achieve this objective, the circular ring and the disc are rotatably connected and are concentrically positioned with respect to one another. It has been shown that this arrangement offers certain shortcomings and drawbacks particularly the following:

During the forward and backward displacement of the device and when the machine is laterally displaced with respect to the surface to be cleaned, there occurs a change in the seat of the cleaning means which then is not any longer parallel to the said surface to be cleaned. This modification has adverse effects on the circular ring and on the flexible annular skirts which then causes leaks of the liquid when the seals are no longer in contact with the place of the surface to be cleaned, even if this occurs only on a small proportion of their circumference. It has also been noted that the seals associated with the ring wear to a different degree than the brushes or abrasive material of the cleaning disc. Accordingly, when the machine is new, the seals associated with the ring are inadequately in contact with the surface to be cleaned, whereas in contrast, these seals are squashed or deformed when and as the machine gets older. The waterproofness is therefore insured for only a short time of the use of such a cleaning device, especially only when the height of the machine provides the seals with the elasticity and coefficient of friction corresponding to a normal cleaning opeation of a surface.

SUMMARY OF THE INVENTION

The present invention has as an object to provide a cleaning device which is waterproof notwithstanding the changes in the seat of the device for cleaning with respect to the surface to be cleaned. The invention concerns an apparatus for the cleaning and the maintenance of floors with a liquid which comprises a cleaning disc mounted for rotation about a vertical axis, a reservoir for the liquid to feed the cleaning area of the disc, and a reservoir or container to collect the liquid which has been used to clean or rinse the surface to be cleaned.

In the device of the invention, the area of cleaning of the disc is circumscribed or limited by a rotatable, hollow circular ring. The surface of this ring with respect to the ground is provided with at least one flexible waterproof skirt which provides a seal in contact with the ground. This ring is connected in a floating manner member with respect to the cleaning disc by the intermediary of flexible arms positioned between and floatingly connecting the ring to the disc.

The device of the invention is further characterized for the evacuation or discharge of the cleaning liquids which are used and dirty, the hollow circular ring which carries the waterproof skirts being placed in communication with a container or chamber concentrically mounted with respect to the axis of rotation of the cleaning disc. This axis of rotation is provided by a hub. The communication between the chamber and ring is provided by means of a flexible conduit or conduits which connects the circular ring to the hub in a manner so that the ring establishes continued contact (all the times) to the ground surface during modification on where of the skirts on the ring notwithstanding the height of the cleaning disc.

This invention has furthermore the following objects which are apparent from the description and from the figures which follow:

DESCRIPTION OF THE PREFERRED EMBODIMENT OF THE INVENTION

Figure 1:
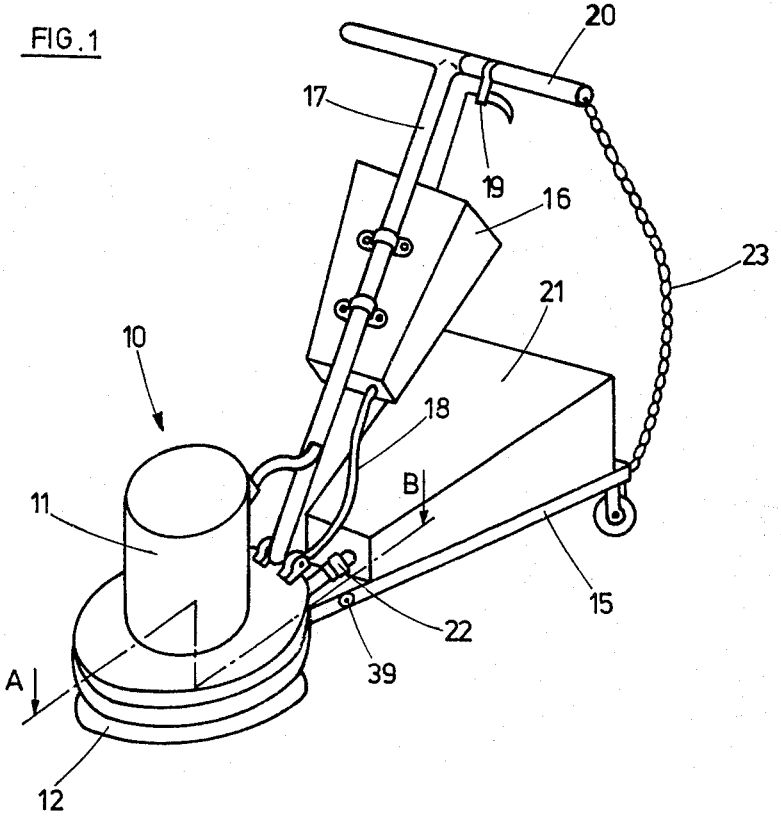
FIG. 1 is a perspective view which shows the apparatus of the invention and its various means.

In accordance with the invention and as is shown in FIG. 1, the device is identified by reference numeral 10. The device of the invention comprises an electrical motor 11 of known type which rotates a cleaning disc 24 such as a brush or an abrasive disc. The area of cleaning is circumscribed by a circular ring 12 which is described in further detail by reference in FIG. 2.

The apparatus of the invention further includes a reservoir or container 16 to supply the liquid for cleaning or for rinsing, this reservoir being preferably positioned on the handle 17 of the apparatus.

Container 16 is connected to the disc or to a cleaning brush by a feeding conduit 18 which is controlled by a valve (not shown) or other equivalent means actuated by valve actuator 19 which is so positioned to be near or on the handle 20 of the apparatus.

Means for connection, such as a cable or a chain 23 is provided between one of the extremeties of handle 20 and chassis 15. This link or chain serves usefully to counteract the torisional couple which is applied to chassis 15 during the rotation of the cleaning disc.

The chassis 15 carries a reservoir 21 which can be connected to the cleaning device by means of link or other means (such as an arm 39) so that the differences in level between the apparatus and the seat of the reservoir do not effect the seat of the cleaning disc.

Figure 2:
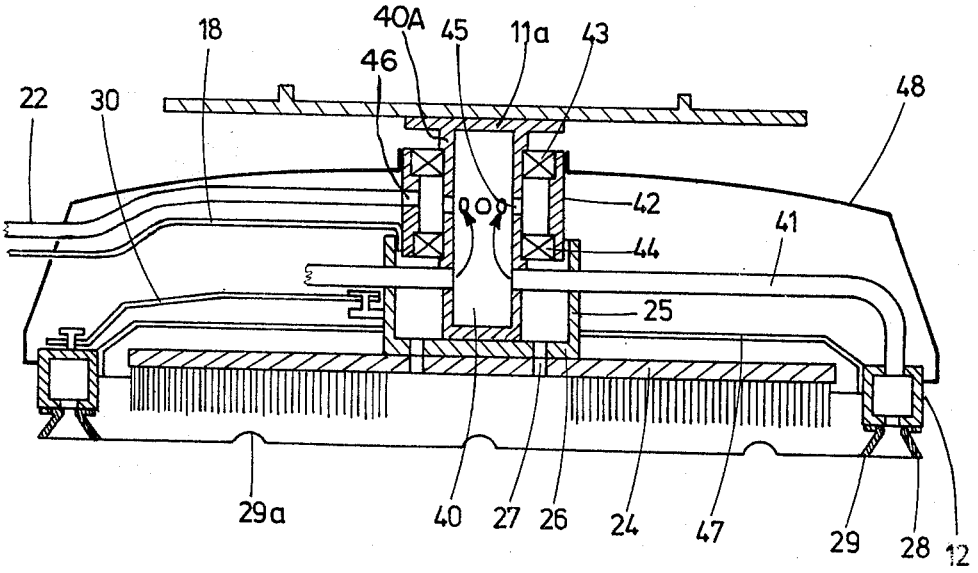
FIG. 2 is a partial transverse view along Line A - B in FIG. 1, looking in the direction of the arrows.

Reference is now made to FIG. 2. The cleaning disc 24 is a rotatable brush which is rotatably driven about a vertically axis by member 11A of the electric motor 10. Member 11A closes the top of a hollow hub 40A, said hub having an interior chamber 40. This hollow hub is concentric with the vertical axis of rotation of the cleaning disc 24.

Disc 24 is provided with a circular receptacle 25 mounted on top and communicating at it's base 26 with the cleaning area of the disc through perforations or holes 27 which are provided for this purpose.

The container or receptacle 25 is carried in rotation at the same speed as disc 24 or even at a reduced speed with respect to the speed of the disc, this by means of a reduction of speed mechanism or other means which is known (not shown).

The receptacle 25 is supplied with cleaning liquid or with rinsing liquid from the container 16 by the feeding conduit 18.

In accordance with one of the embodiments of the invention, the cleaning disc has its area circumscribed by the circular ring 12. The face of the ring 12 with respect to the ground or floor is provided with two flexible skirts 28 and 29 for waterproofness which form a flexible seal in contact with the ground. In the embodiment shown, it is to be noted that the lower level of the hairs of the brush of the rotatable disc 24 is positioned appreciably above the plane of contact of the flexible skirts employed 28 and 29 with the floor. In effect therefore, when the device freely rests on the ground, the hairs of the brush and the skirts employed to provide waterproofness are on the same level. This is because circular ring 12 is mounted floatably especially with respect to the rotational axis of disc 24.

The floatable mounting of circular ring 12 is performed by one or more intermediate, flexible arms 30 which are movably linked to the lateral edge of container 25 and to the superior or upper face of the ring 12, as shown in FIG. 2. There can be for instance three arms 30 positioned approximately at 120° apart. Since the receptacle 25 is mounted on the cleaning disc 24, the flexible arms floatably connect the cleaning disc to the ring.

In accordance with an embodiment of the invention, the circular ring 12 is placed in communication with the interior chamber 40 of the hollow hub 40A. This communication is made by means of flexible conduits 41, for instance three in number, the flexible conduit allowing for the free displacement of ring 12 relative to the cleaning disc 24, particularly in the axial direction.

Each flexible conduit 41 communicates with the interior chamber 40 of hub 40A by extending radially through the walls of the circular container or receptacle 25. This container 25 receives the cleaning liquid from feeding conduit 18, and feeds the cleaning disc 24 through perforations 27. The dirty liquid charged with dirt is directed into chamber 40 through the flexible conduit 41 communicating the chamber with the circular ring 12. This dirty liquid is extracted from the chamber 40 into a collecting chamber 42 coaxially positioned with respect to the hollow hub 40A. The hollow collecting chamber 42 penetrates partially into the receptacle 25, and the feeding conduit 18 for directing the cleaning liquid into the receptacle 25 opens into the annular space between the receptacle 25 and the hollow. collecting chamber 42. The collecting chamber 42 is supported at extremeties by supports 43 and 44 so that it can be maintained in a stationary position during the rotation of the hub 40A.

Openings 45 are provided in the sidewall of the hub 40A to communicate the hub with the collecting chamber 42. An opening 46 is provided in the sidewall of chamber 42, this opening being connected with the conduit 22 through which suction is applied.

A deflector 47, such as a flexible lip or apron, is positioned above the cleaning disc 24. One end of the deflector 37 is connected to the receptacle 25, and the other end of said deflector extends radially beyond the cleaning disc and is connected to the lateral inside wall of the circular ring 12. This deflector prevents the centrifugal sprinkling of the cleaning liquid created by rotation of the cleaning disc 24.

Finally, there is a protection cover 48 which surrounds the elements of the device, and is connected to the sidewall of the collecting chamber 42. If desired, the cover can be made independent of the stationary chamber 42.

I claim:

1. A cleaning device for cleaning a floor or other surface, said device including a cleaning disc having a vertical axis of rotation, a reservoir feeding cleaning liquid to the disc and means to control the flow of cleaning liquid, the improvement which comprises:

A. a rotatable hollow hub concentric with the axis of rotation of the cleaning disc and mounting said disc;

B. a circular ring having an interior compartment and a passageway communicating the interior compartment with the surface to be cleaned, said ring surrounding the cleaning disc for defining the area to be cleaned and including downwardly directed flexible skirts forming said passageway;

C. floatable mounting means connecting the cleaning disc to the circular ring for permitting floating movement of the ring relative to the disc, whereby the flexible skirts can be maintained in contact with the surface being cleaned under all conditions of use;

D. a flexible conduit interconnecting the interior compartment of the circular ring with the interior of the hollow hub; and E. suction means applies to the hollow hub, whereby dirty cleaning liquid can be removed from the surface being cleaned through the circular ring and the flexible conduit connecting the interior compartment of the ring with the interior of the hollow hub.

2. The cleaning device of claim 1 and a cleaning liquid container carried by the hollow hub, conduit means carrying cleaning liquid from the reservoir to the cleaning liquid container and means to introduce cleaning liquid from the container to the cleaning disc to apply the cleaning liquid to the floor.

3. The cleaning device of claim 2 wherein the means to introduce include a path intercommunicating between the container and the cleaning disc.

4. The cleaning device of claim 3 wherein the flexible conduit traverses the cleaning liquid container.

5. The cleaning device of claim 2, wherein said floatably mounting means includes a flexible arm movably linked to said cleaning liquid container and said circular ring.

6. The cleaning device according to claim 5 wherein the flexible arm and the flexible conduit flex to adjust the elevation of the ring relative to the elevation of the circular disc.

7. The cleaning device of claim 2, wherein the cleaning liquid container is connected to the disc and concentrically mounted with the vertical axis of rotation of said disc.

8. The cleaning device of claim 7, wherein the floatably mounting means includes a flexible arm movably linked to said cleaning liquid container and said circular ring.

9. The cleaning device of claim 1, including a stationary collecting chamber positioned about the hollow hub and coaxially aligned with the vertical axis of rotation of the cleaning disc, passageways extending through a wall of the hollow hub to communicate its interior chamber with the collecting chamber and a passageway through a wall of the collecting chamber through which said suction means acts.

10. The cleaning device of claim 9, including a cleaning liquid container carried by the hollow hub, conduit means carrying cleaning liquid from the reservoir to the cleaning liquid container and means to introduce cleaning liquid from the container to the cleaning disc to apply the cleaning liquid to the floor.

11. The cleaning device of claim 10 wherein the cleaning liquid container is connected to the disc and is concentrically mounted with the vertical axis of rotation of said disc.

12. The cleaning device of claim 11 wherein said floatably mounting means includes a flexible arm movably linked to said cleaning liquid container and said circular ring.

13. The cleaning device of claim 10 wherein the floatably mounting means includes a flexible arm movably linked to said cleaning liquid container and said circular ring.

* * * * *